US008086123B2

(12) United States Patent
Ito

(10) Patent No.: US 8,086,123 B2
(45) Date of Patent: Dec. 27, 2011

(54) IMAGE FORMING APPARATUS

(75) Inventor: Shigeharu Ito, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 401 days.

(21) Appl. No.: 12/356,887

(22) Filed: Jan. 21, 2009

(65) Prior Publication Data

US 2009/0245828 A1 Oct. 1, 2009

(30) Foreign Application Priority Data

Mar. 25, 2008 (JP) ..... 2008-077749

(51) Int. Cl.
*G03G 15/00* (2006.01)

(52) U.S. Cl. ..... 399/49; 399/53; 399/55

(58) Field of Classification Search ..... 399/49, 399/53, 55

See application file for complete search history.

(56) References Cited

U.S. PATENT DOCUMENTS

| | | | | |
|---|---|---|---|---|
| 5,724,627 | A * | 3/1998 | Okuno et al. | 399/49 |
| 2006/0098997 | A1 * | 5/2006 | Kim et al. | 399/49 |
| 2008/0187337 | A1 * | 8/2008 | Kim et al. | 399/55 |

FOREIGN PATENT DOCUMENTS

JP 2853865 11/1998

* cited by examiner

*Primary Examiner* — Ryan Walsh
(74) *Attorney, Agent, or Firm* — K&L Gates LLP

(57) ABSTRACT

An image forming apparatus includes: an image formation control unit for forming print images on an image carrier and for forming a reference toner pattern having a predetermined size between the print images formed on the image carrier; a reference image density detecting unit for detecting a image density of the reference toner pattern; and an image forming condition adjusting unit for adjusting an image forming condition based on the image density detected by the reference image density detecting unit. If a toner amount of one or plurality of the print images is greater than a predetermined value, the image formation control unit prevents any further adjustment operation performed by the image forming condition adjusting unit.

9 Claims, 10 Drawing Sheets

【FIG.1】
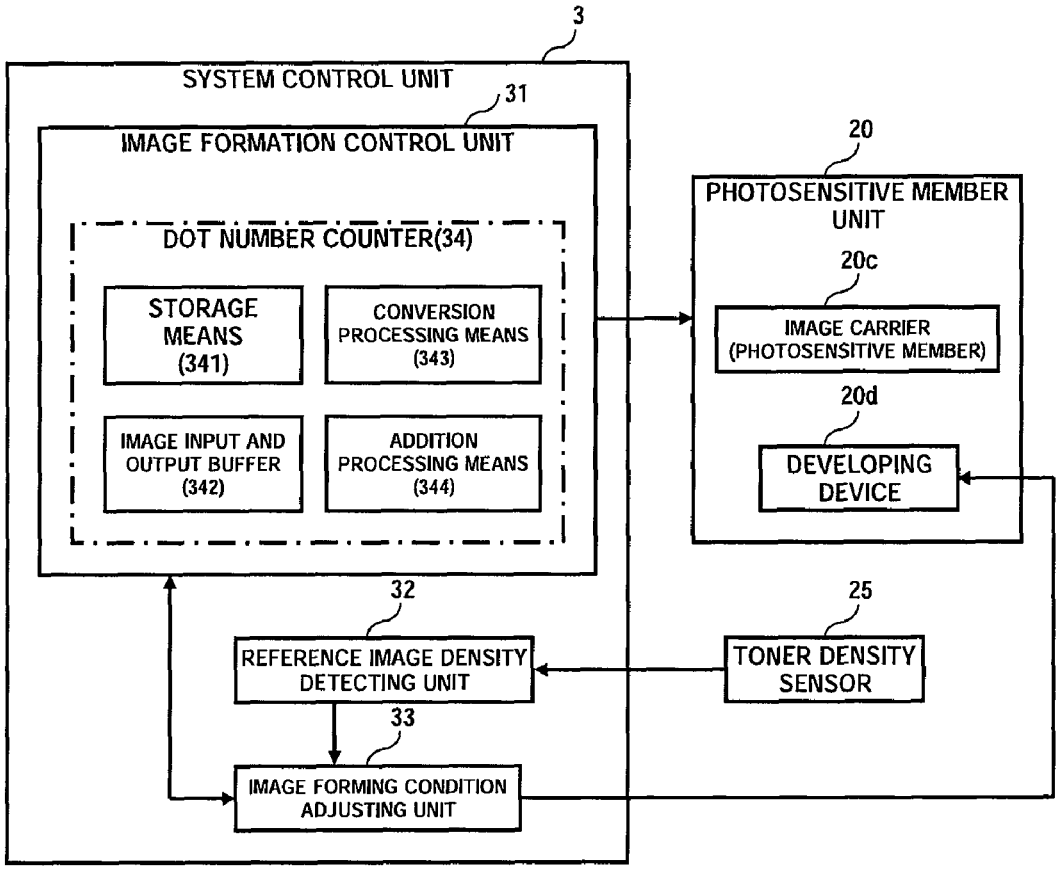

【FIG.2】
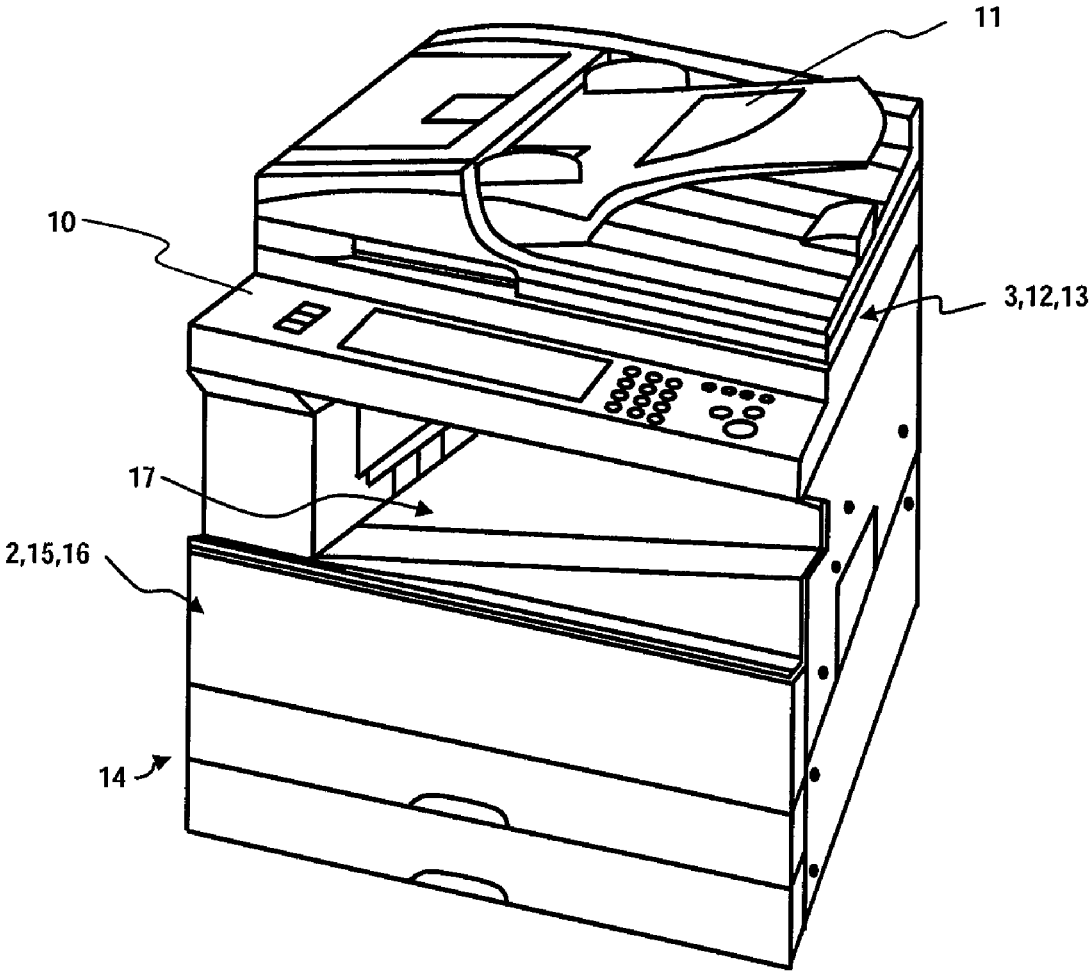

【FIG.3】
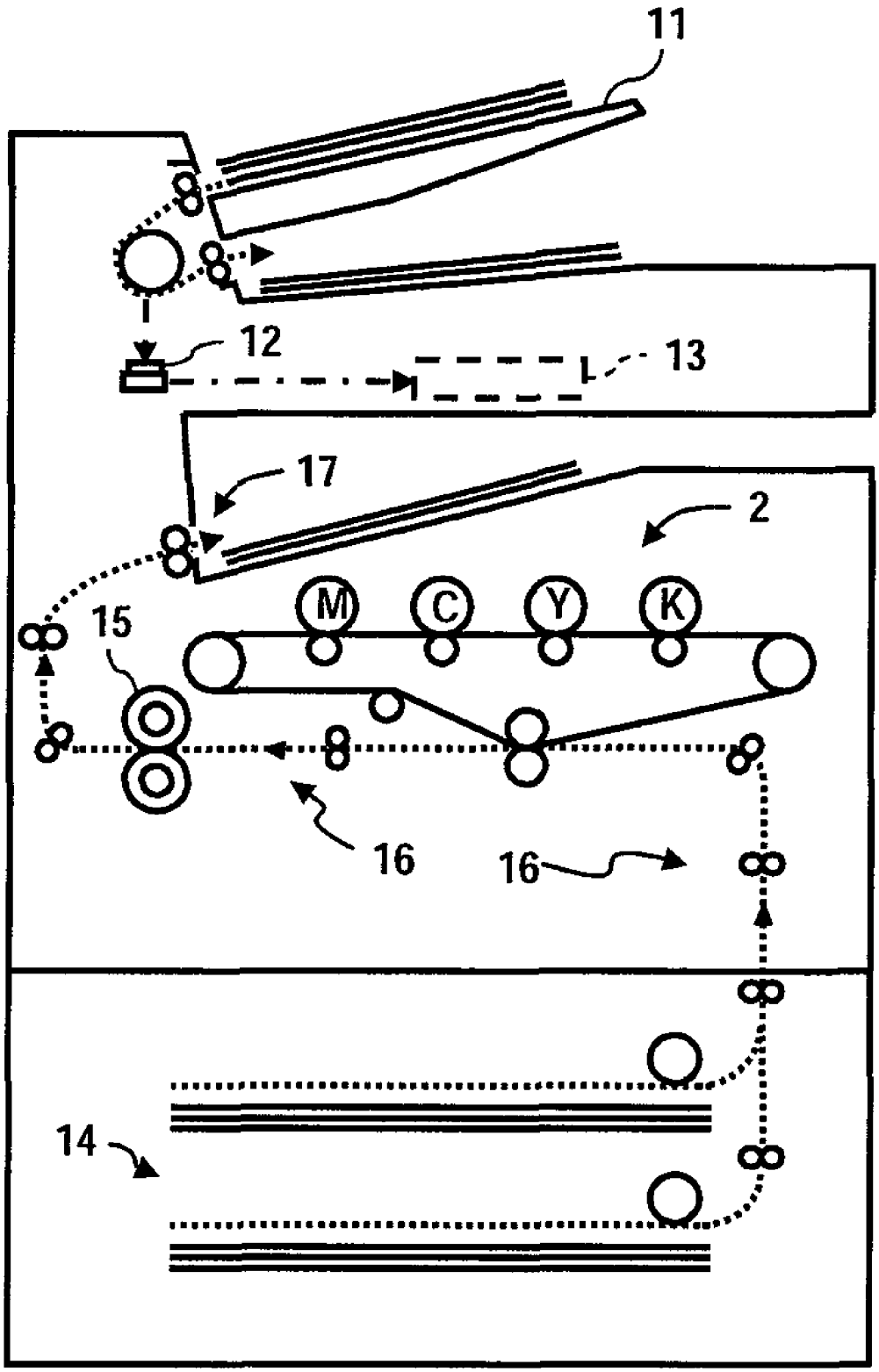

【FIG.4】
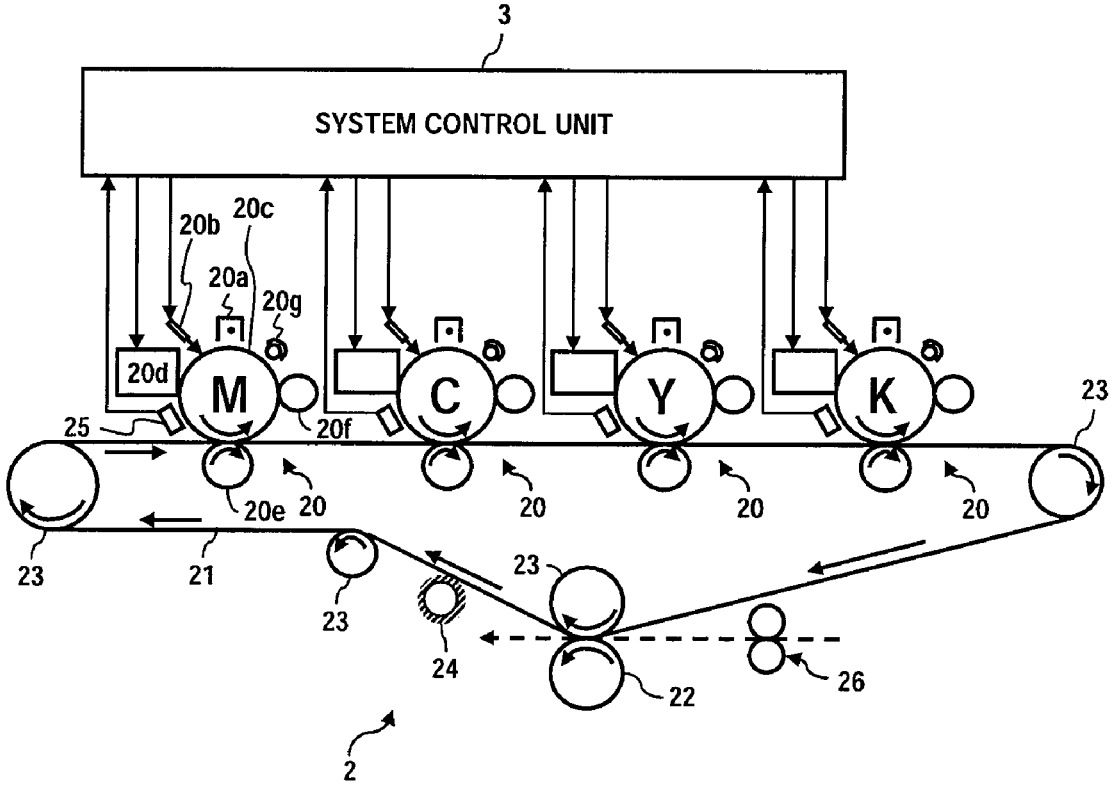

【FIG.5】
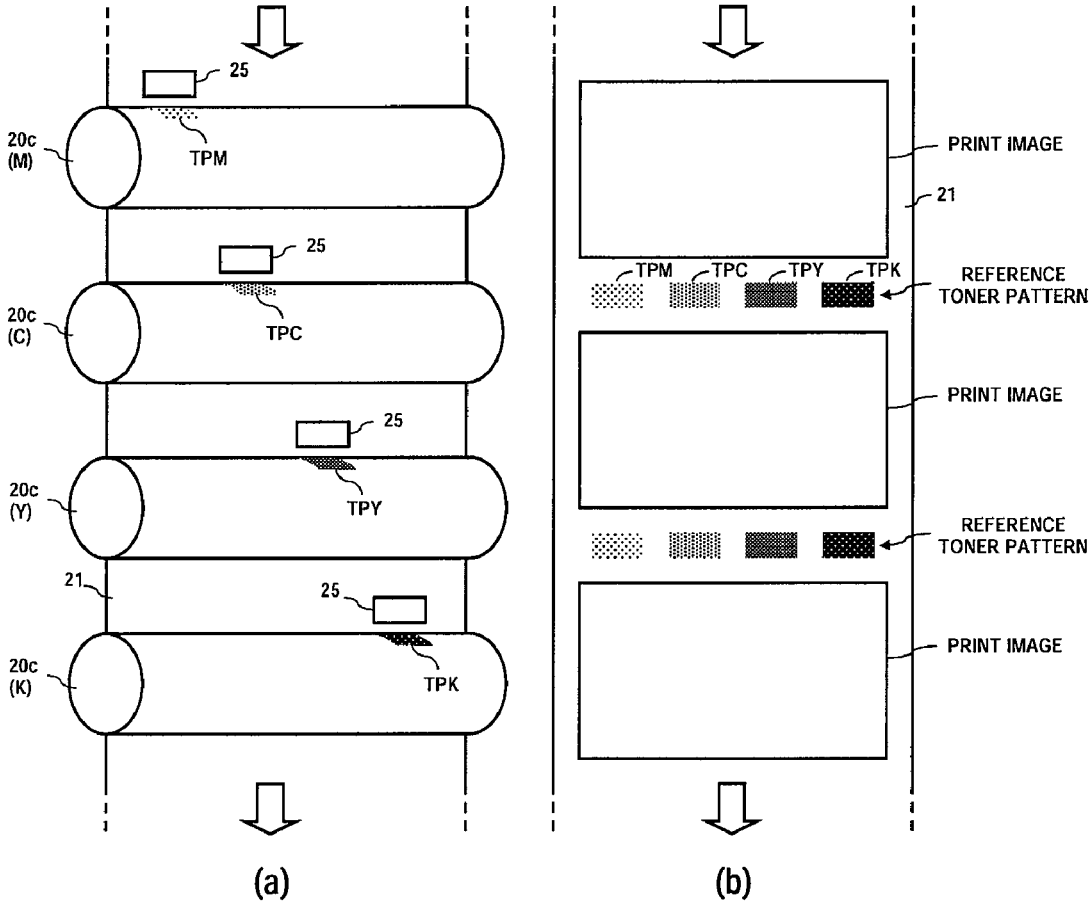

[FIG.6]
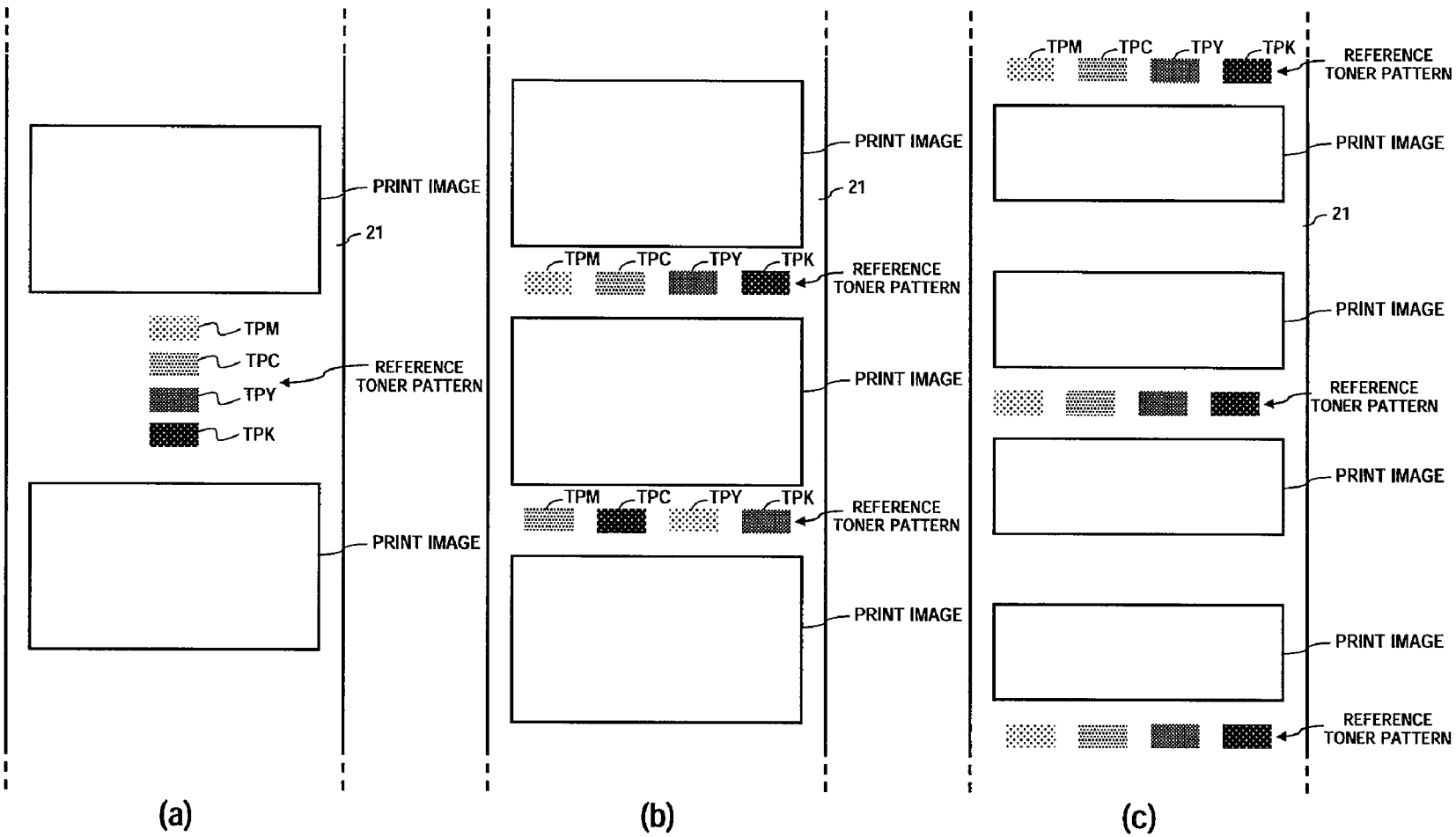

【FIG.7】
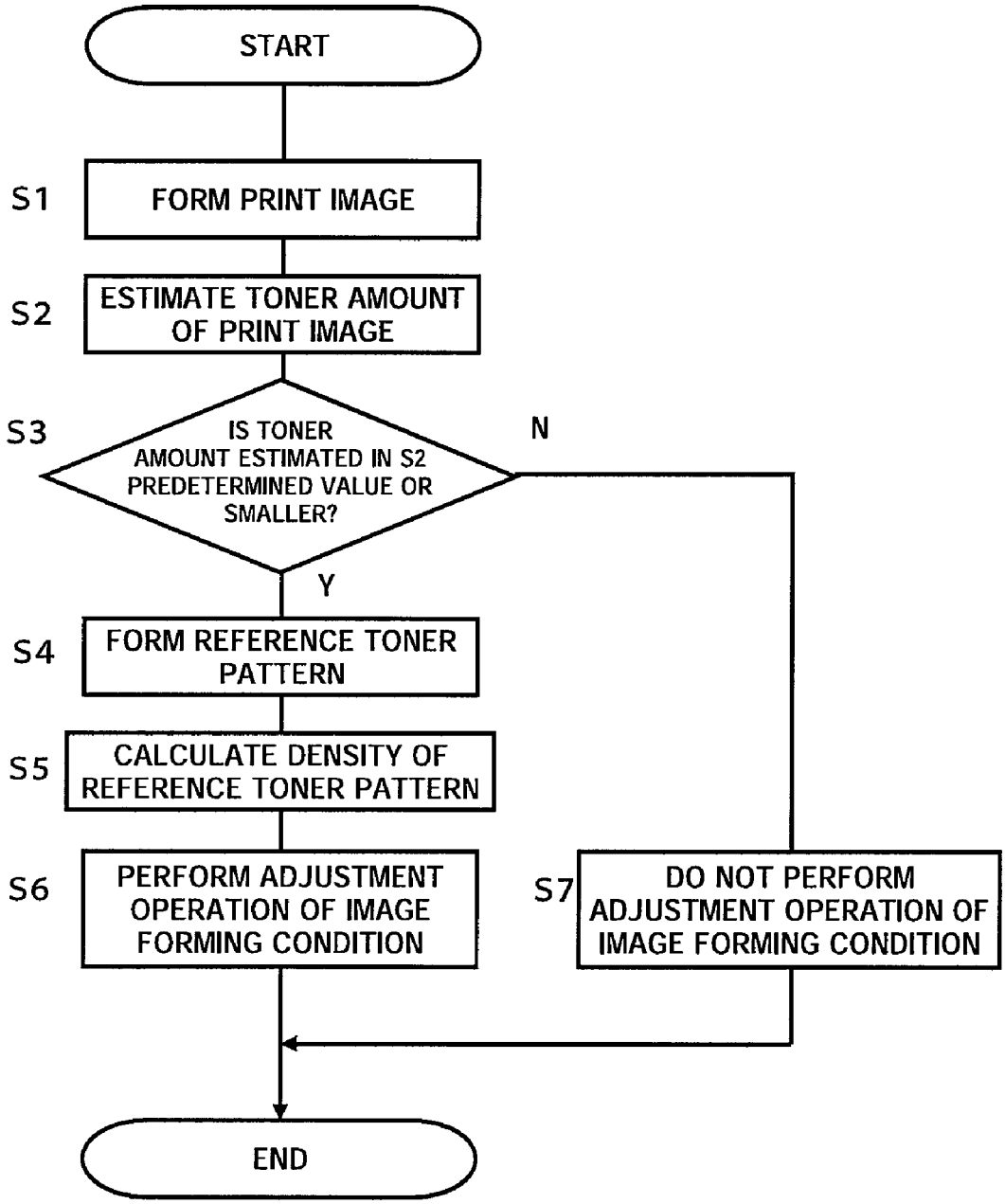

【FIG.8】
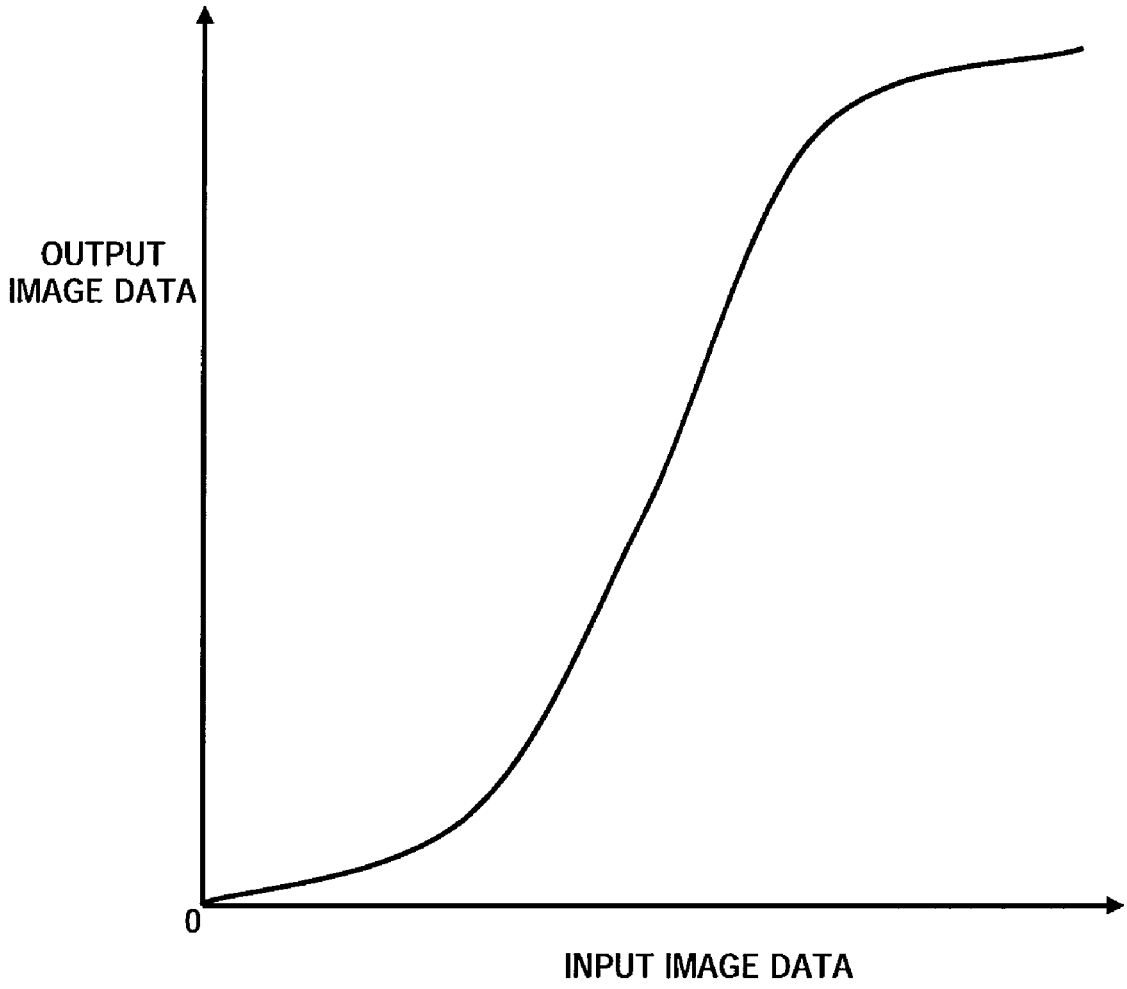

【FIG.9】
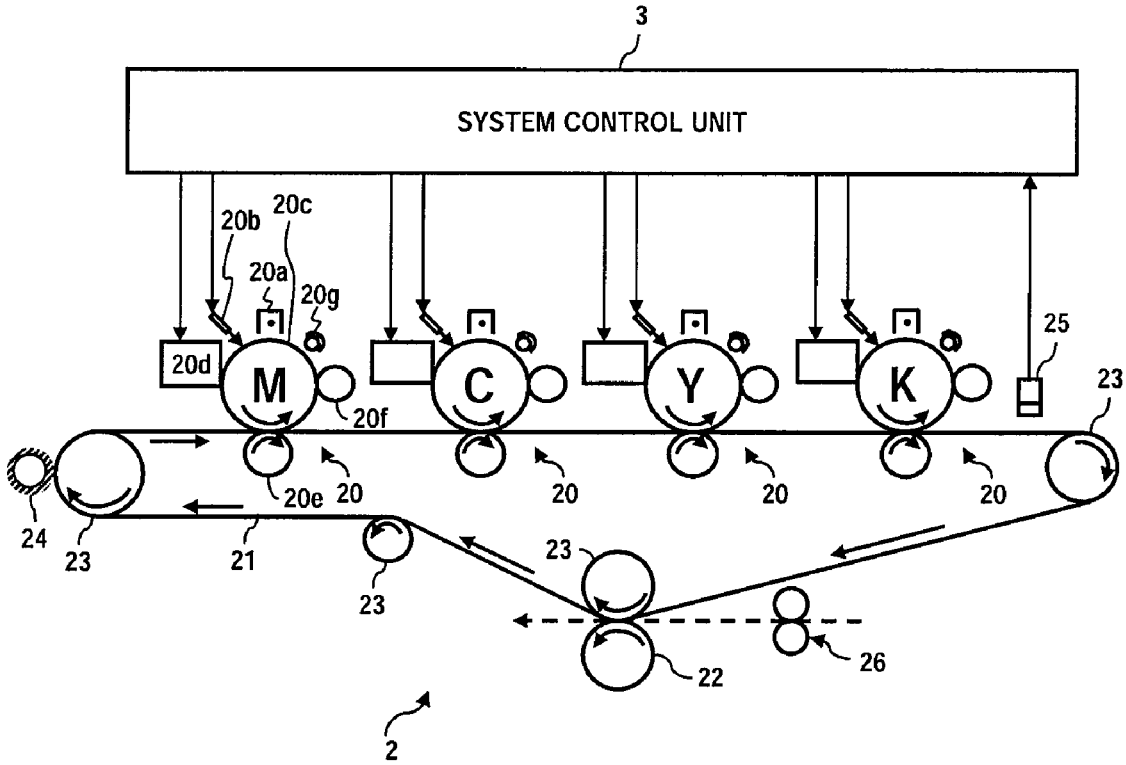

【FIG.10】
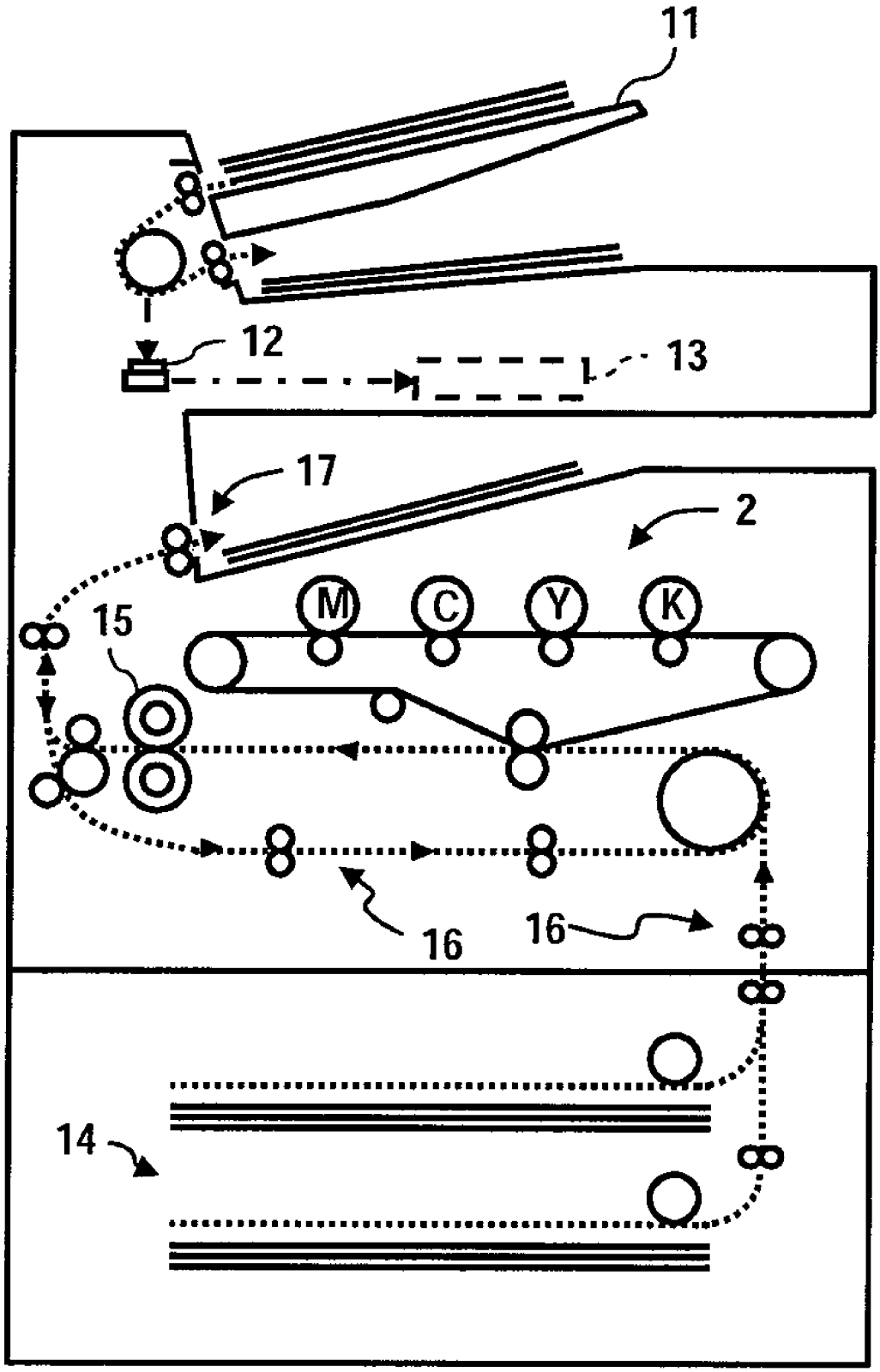

IMAGE FORMING APPARATUS

INCORPORATION BY REFERENCE

This application is based upon and claims the benefit of priority from the corresponding Japanese Patent Application No. 2008-77749 filed on Mar. 25, 2008, the entire contents of which is incorporated herein by reference.

FIELD OF THE INVENTION

The present invention relates to an image forming apparatus including: an image formation control unit for forming print images on an image carrier and a toner pattern having a predetermined size between the print images on the image carrier; a reference image density detecting unit for detecting a image density of the reference toner pattern; and an image forming condition adjusting unit for adjusting an image forming condition based on the image density detected by the reference image density detecting unit.

BACKGROUND

Copy machines are equipped with a developing device, which includes a toner density sensor for detecting a toner density in the device. When the toner density in the device becomes a predetermined value or lower, the image forming apparatus controls a toner replenishment motor so as to supply toner to the device so that a mixing ratio of the toner to carrier (T/C ratio) in the device can be maintained at a constant value.

Additionally, the image forming apparatus adjusts the image forming condition preventing the image density of the print image, as a toner image formed on the image carrier, from fluctuating because of variations in temperature or the like and time variations including a deterioration of the image carrier such as a photosensitive member or deterioration of toner.

The image forming apparatus defines a reference toner pattern for adjusting the image density between a plurality of print images as illustrated in FIG. 5B. Then, the image forming apparatus adjusts the image forming condition including a developing bias, an input and output data conversion table and the like based on the toner density of the reference toner pattern detected by the toner density sensor arranged so as to be opposed to the surface of the image carrier.

However, if the toner density in the developing device decreases because of lack of toner in a toner replenishment container for replenishing the toner to the developing device or other reasons, the amount of toner adhering to the reference toner pattern formed on the surface of the image carrier becomes lower than when the toner density in the developing device is not low and the same surface potential of the image carrier.

If the adjustment of the image forming condition is performed based on the reference toner pattern using an amount of toner with low adhesion, an excessive amount of toner may adhere to the image carrier when the toner density in the device is at a normal value after the adjustment by the toner replenishment motor, resulting in a high image density of the print image.

To resolve the problem, there is provided an image forming control method wherein, if the time to detect an adhering toner amount on the above-mentioned reference toner pattern (i.e., timing for performing the adjustment of the image forming condition) comes when the toner density in the developing device is at a predetermined level or lower, the timing is delayed by a predetermined period of time so that the image forming condition can be corrected.

However, if the image forming apparatus forms the reference toner pattern between images under printing so that the adjustment of the image forming condition is performed during the printing period so as to avoid a decrease in printing speed or other reason, the following issues may occur.

Specifically, in the prior art, the timing for detecting the adhering toner amount is delayed by the predetermined period of time in accordance with a decrease in toner density in the developing device. Therefore, the process is performed after the toner density in the developing device is actually decreased. For this reason, it is not possible to merely shift timing.

SUMMARY

It is an advantage of the present invention to provide an image forming apparatus that can stabilize a image density of a print image by avoiding an incorrect adjustment of the image forming condition even if an image having a high image density is printed when the reference toner pattern is formed between images under printing so that the adjustment of the image forming condition is performed during the printing period.

An image forming apparatus according to an embodiment of the present invention comprises: an image formation control unit for forming print images on an image carrier and for forming a reference toner pattern between the print images formed on the image carrier; a reference image density detecting unit for detecting a image density of the reference toner pattern; and an image forming condition adjusting unit for adjusting an image forming condition based on the image density detected by the reference image density detecting unit. The image formation control unit causes the image forming condition adjusting unit to perform an adjustment operation based on the image density of the reference toner pattern detected by the reference image density detecting unit if a toner amount of one or plurality of the print images is smaller than a predetermined value, and prevents the image forming condition adjusting unit from further performing the adjustment operation if the toner amount of the one or plurality of the print images is larger than the predetermined value.

Additional features and advantages are described herein, and will be apparent from the following Detailed Description and the figures.

BRIEF DESCRIPTION OF THE FIGURES

In the accompanying drawings:

FIG. 1 is a block structural diagram of an image forming apparatus;

FIG. 2 is an outline diagram of a digital multifunction peripheral;

FIG. 3 is an explanatory diagram of an internal structure of the digital multifunction peripheral;

FIG. 4 is an explanatory diagram of an image output unit;

FIG. 5A is an explanatory diagram of reference toner patterns, in a direction perpendicular to a conveying direction of an intermediate transfer belt, and FIG. 5B is an explanatory diagram illustrating a state where the reference toner patterns of FIG. 5A are transferred onto the intermediate transfer belt;

FIG. 6A is an explanatory diagram illustrating a state where the reference toner patterns, that are arranged in a direction parallel to the conveying direction of the intermediate transfer belt, are transferred onto the intermediate transfer belt, FIG. 6B is an explanatory diagram illustrating a state where the reference toner patterns that have variable densities between print images are transferred onto the intermediate transfer belt, and FIG. 6C is an explanatory diagram illustrating a state where the reference toner patterns that have been formed only once for several print images are transferred onto the intermediate transfer belt;

FIG. 7 is a flowchart for illustrating control of an adjustment operation of an image forming condition performed by the image forming apparatus;

FIG. 8 is an explanatory diagram of a gradation conversion table;

FIG. 9 is an explanatory diagram of the image output unit in the case where a toner density sensor is disposed so as to be opposed to the intermediate transfer belt; and FIG. 10 is an explanatory diagram of an internal structure of a digital multifunction peripheral that is capable of duplex printing.

DETAILED DESCRIPTION

Hereinafter, an embodiment of the present invention is described, in which an image forming apparatus is a tandem type color digital multifunction peripheral.

As illustrated in FIGS. 2 and 3, the digital multifunction peripheral includes: an operation unit 10 having a display unit having a liquid crystal screen, and a start key for starting a copy operation; an image reading unit 12 for feeding original sheets placed on an original sheet feed platform 11 one by one and for reading original images as digital image data by photoelectric conversion; an image processing unit 13 for performing image processing, such as a gradation conversion, a color adjustment, and a scale factor conversion on the digital image data so as to convert the digital image data, into output image data including magenta (M), cyan (C), yellow (Y) and black (K) components; an image output unit 2 for forming a print image as a toner image based on the output image data transferred the toner image onto recording paper; a fixing unit 15 for fixing the print image on the recording paper; a paper housing unit 14 for housing paper sheets to be fed to the unit 2; a paper conveying mechanism 16, for moving the paper sheets from the paper housing unit 14; a paper discharging unit 17, for discharging the paper sheets; and a system control unit 3 controlling the above-mentioned functional so as to perform the processes.

As illustrated in FIG. 4, the image output unit 2 includes a plurality of photosensitive member units 20. The units include a photosensitive member 20*c*, as an image carrier for creating the print image, an intermediate transfer belt 21 for primarily transferring the print images formed on the photosensitive members 20*c*, a primary transfer roller 20*e*, a support roller 23 for supporting and rotating the transfer belt 21 at a predetermined rotation speed, a secondary transfer roller 22 for transferring the print image formed on the intermediate transfer belt 21 onto the recording paper fed when the transfer timing is adjusted a registration roller 26 leading edge of the recording paper is corrected and a brush 24 for removing residual toner image on the intermediate transfer belt 21 after the print image is transferred onto the recording paper.

In the illustrated embodiment, four photosensitive member units 20 are located along the circumferential direction of the intermediate transfer belt 21, and the photosensitive member units 20 respectively corresponding to magenta (M), cyan (C), yellow (Y) and black (K) colors.

The photosensitive member units 20 of individual colors have the same structure. These include the photosensitive member 20*c*, an electrifying charger 20*a* for uniformly electrifying the surface of the photosensitive member 20*c*, an exposure head 20*b* that is driven by output image data corresponding to a toner color of its own unit, a developing device 20*d* for forming the print image by developing an electrostatic latent image formed on the photosensitive member 20*c* through exposure performed by the exposure head 20*b*, a cleaning blade 20*f* for removing toner remaining on the photosensitive member 20*c* after the primary transfer onto the intermediate transfer belt 21, and an antistatic lamp 20*g* for eliminating electric charges on the surface of the photosensitive member 20*c*.

In addition, the image forming apparatus includes toner density sensors 25, each of which is located opposite to the surface of the photosensitive member 20*c* of each of the photosensitive member units 20.

The toner density sensor 25 comprises infrared reflection type photo sensor or the like, and the toner density sensor 25 projects light to the reference toner pattern for adjusting the image forming condition formed on the surface of the photosensitive member 20*c* so as to receive its reflection light and deliver a signal having a level based on the reflection light when an adjustment operation of the image forming condition is performed.

The system control unit 3 includes a CPU, a ROM for storing a program to be executed by the CPU, a RAM for storing data and the like, an input port for receiving signals from various sensors and the like, and an output port for transporting a control signal to various driving devices such as motors.

The system control unit 3 includes a plurality of control units for controlling individual units of the digital multifunction peripheral to perform predetermined processes as the digital multifunction peripheral. The functions of each of the control units is performed by the CPU that executes the control program so as to drive the necessary hardware.

As illustrated in FIG. 1, the system control unit 3, according to an embodiment of the present invention, includes an image formation control unit 31 for forming the print image on the photosensitive member 20*c* provided to each of the plurality of photosensitive member units 20 and for forming the reference toner pattern having a predetermined size between the print images formed on the photosensitive member 20*c*, a reference image density detecting unit 32 for detecting an image density of the reference toner pattern, and an image forming condition adjusting unit 33 for adjusting the image forming condition based on the image density detected by the reference image density detecting unit 32, as some of the plurality of control units described above.

In the embodiment, the image forming apparatus is a color digital multifunction peripheral. Therefore, the image formation control unit 31 forms print images having different toner colors on the plurality of photosensitive members 20*c*, and forms the reference toner pattern having a predetermined size between print images formed on each of the photosensitive members 20*c*.

In other words, the image formation control unit 31 controls the photosensitive member units 20 of individual colors, and therefore the print image and the reference toner pattern are formed for each of the colors.

The reference toner pattern is made up of a plurality of toner images of a solid density, or a predetermined halftone density formed, on the surface of the photosensitive member 20*c* by the exposure head 20*b* and the developing device 20*d* based on test patch data expressed with a gradation pattern having a preset predetermined number of gradations outputted from the image processing unit 13.

For instance, as illustrated in FIG. 5A, reference toner patterns TPM, TPC, TPY and TPK of individual colors are formed on the photosensitive members 20*c* of individual colors, respectively. FIGS. 5A and 5B are diagrams of the image output unit 2 viewed from the top.

The reference toner patterns of the individual colors are formed on the intermediate transfer belt 21 at different positions in a direction perpendicular to the conveying direction so that the reference toner patterns do not overlap each other as illustrated by an arrow in FIG. 5A. Therefore, the toner density sensors 25 for the individual colors are also disposed at different positions in a direction perpendicular to the conveying direction of the intermediate transfer belt 21.

FIG. 5B illustrates the print image and the reference toner pattern image that are formed by the image formation control unit 31 and are transferred onto the intermediate transfer belt 21. In this example, the reference toner patterns of individual colors are transferred between print images at constant intervals in a direction perpendicular to the conveying direction of the intermediate transfer belt 21.

Note that the reference toner patterns may be patterns other than the patterns illustrated in FIG. 5B, including the reference toner patterns of individual colors arranged in the direction parallel to the conveying direction of the intermediate transfer belt 21 as illustrated in FIG. 6A, and the patterns having variable density between print images as illustrated in FIG. 6B. It should be noted that the reference toner pattern is not limited to the pattern that is disposed at every interval between print images, but the reference toner pattern may be disposed only once for several print images as illustrated in FIG. 6C (once for two print images in FIG. 6C).

The reference image density detecting unit 32 determines density values of the reference toner patterns of individual colors based on levels of the signals supplied from the toner density sensors 25 of individual colors to the image formation control unit 31.

The image forming condition adjusting unit 33 adjusts the image forming conditions based on each of the image density values detected by the reference image density detecting unit 32. In other words, the image forming condition adjusting unit 33 adjusts the image forming conditions of M, C, Y and K colors.

A process for adjusting the image forming condition for one of M, C, Y and K colors is described in detail. The image forming condition adjusting unit 33 compares the image density of the reference toner pattern detected by the reference image density detecting unit 32 (detected density) with a predetermined density corresponding to a preset reference toner pattern, and performs an adjustment of a developing bias voltage for the developing device 20*d* based on a difference between a set density and the detected density. The detected density is maintained to be the set density. The developing bias voltage is set to a high level if the detected density is low and is set to a low level if the detected density is high, for instance.

This adjustment of the image forming condition is performed every time the reference image density detecting unit detects the image density of the reference toner pattern. In other words, the adjustment is performed at every interval between print images. Then, the result of the every adjustment of the image forming condition is fed back to the control, whereby the toner density is maintained at an appropriate value. Note that the adjustment of the image forming condition may be performed once for a few print images instead of once for every interval between print images.

The image formation control unit 31 is formed so that if a toner amount of the print image is greater than a predetermined value, any further adjustment operation of the image forming condition adjusting unit 33 is prevented.

According to this structure, the image formation control unit 31 determines whether or not an adjustment should be performed based not on the toner density in the developing device but the amount of toner of the print image. Therefore, the consumption of a large amount of toner is detected promptly so as to prevent the adjustment operation. In other words, an incorrect correction of the adjustment operation can be avoided.

The image formation control unit 31 includes a dot number counter 34 for counting the number of dots of the print image for each of toner colors. If any one of totals of the counted values of a predetermined number of print images of individual toner colors, which are counted by the dot number counter 34, is greater than a predetermined threshold value, the toner amount to be used for the print image is determined to be larger than a predetermined value.

The dot number counter 34 counts the number of dots when the print image is printed on the recording paper based on the output image data supplied to the exposure head 20*b*.

The dot number counter 34 includes storage means 341, defined in a part of a storage area of the RAM for storing a lookup table for converting numerical data of predetermined bytes into the number of bits corresponding to print dots, conversion processing means 343, for reading the output image data buffered in an image input and output buffer 342 by a predetermined byte unit and performing a conversion process on the read numerical data into the number of bits corresponding to print tots based on the lookup table, and addition processing means 344 for totaling the converted number of bits, whereby the toner amount to be consumed for the print image is estimated.

A predetermined number of print images can be a plurality of print images or may be one print image. A predetermined threshold value is 30% to 40%, for example, where 100% corresponds to a situation wherein each of a predetermined number of print images is a solid image of a color for which the toner amount (the number of dots) is to be computed (in the following description, the predetermined threshold value is 30%).

The counting of the number of dots is performed for each of M, C, Y and K colors. If the ratio with respect to the solid image exceeds 30% when the number of dots is calculated for any one of the M, C, Y and K colors (e.g., only the cyan (C) color), it is determined that only the toner amount to be used for the print image is greater than the predetermined value. Then, the adjustment operation is prevented for all of M, C, Y and K colors.

In this way, according to the structure using the dot number counter, the number of dots in the print image is counted, whereby the toner amount of the print image can be easily estimated.

Note that the image formation control unit 31 can have a structure wherein if the ratio with respect to the solid image exceeds 30%, when the number of dots is calculated for any one of M, C, Y and K colors (e.g., only the cyan (C) color), it is determined that only the toner amount to be used for cyan of the print image is greater than the predetermined value, and the adjustment operation for only cyan is prevented.

In other words, it is possible to provide a structure in which the image formation control unit 31 includes the dot number counter 34 for counting the number of dots of the print image for each of toner colors. If any one of the totals of the counted values of the predetermined number of print images of the individual toner colors, which are counted by the dot number counter 34, is greater than the predetermined threshold value, it is determined that the toner amount to be used for the print image is greater than the predetermined value, and any further adjustment operation for the toner color performed by the image forming condition adjusting unit 33 is prevented.

According to this structure, the adjustment operation is prevented only for a specific color for which the toner amount in the developing device may be decreased. Thus, the adjustment operation can be performed for colors for which the toner amount is not decreased, and an incorrect implementation of the adjustment operation can be avoided for a color for which the toner amount may be decreased.

The image formation control unit 31 has a structure in which a print image formation is suspended when the adjustment operation is prevented a predetermined number of times; the predetermined number of times can be once.

For instance, the predetermined number of print images can be one image and that the predetermined number of times can be three times. In this situation, when the image formation control unit 31 determines that the toner amount is greater than the predetermined value continuously for three print images and thereby prevents the adjustment operation, the image formation control unit 31 controls the photosensitive member unit 20 to suspend subsequent print image formation.

As way of example, the predetermined number of print images can be three images and that the predetermined number of times can be three times. In this situation, if the image formation control unit 31 determines that each of the total values of toner amounts of print images corresponding to first to third images, second to forth images, and third to fifth images is greater than the predetermined value and thereby prevents the adjustment operation, or if the image formation control unit 31 determines that each of the total values of toner amounts of print images corresponding to first to third images, forth to sixth images, and seventh to ninth images is greater than the predetermined value and thereby prevents the adjustment operation, the image formation control unit 31 controls the photosensitive member unit 20 to suspend subsequent print image formation.

If the adjustment operation is prevented for a predetermined number of times, the toner density in the developing device may be decreased because of a tendency to consume a larger amount of toner. In this case, however, according to the structure described above, the image formation control unit 31 suspends the print image formation. Therefore, it is possible to avoid forming a print image with a reduced image density because of a decrease in the toner density in the developing device.

The image formation control unit 31 has a structure in which after the print image formation is suspended, the reference toner pattern is formed without forming the print image, and the image forming condition adjusting unit 33 is activated.

In other words, the image formation control unit 31 does not form the print image and the reference toner pattern alternately as illustrated in FIG. 5B, but forms only the reference toner pattern at least once. The image forming condition adjusting unit 33 activated by the image formation control unit 31 adjusts the image forming condition based on the formed reference toner pattern.

Therefore, the image forming condition can be adjusted while avoiding any adverse effect on the image density of the print image.

Further, it is preferable that the image formation control unit 31 has a structure wherein the suspended print image formation is resumed after the adjustment performed by the image forming condition adjusting unit 33 is completed.

Referring now to the flowchart illustrated in FIG. 7, control of the adjustment operation of the image forming condition performed by the image forming apparatus will now be described.

The image formation control unit 31 controls the photosensitive member unit 20 to form the print image (S1). The image formation control unit 31 estimates the toner amount of the print image based on the total of the counted values of the predetermined number of print images of each toner color, which are calculated by the dot number counter 34 (S2).

If the toner amount estimated in Step S2 is a predetermined value or lower (Yes in S3), the image formation control unit 31 causes the photosensitive member unit 20 to form the reference toner pattern (S4). The reference image density detecting unit 32 calculates a image density of the reference toner pattern based on a detection value of the toner density sensor 25 (S5). The image forming condition adjusting unit 33 performs the adjustment operation of the image forming condition based on the image density of the reference toner pattern calculated in Step S5 (S6).

If the toner amount estimated in Step S2 is greater than the predetermined value (No in S3), the image forming condition adjusting unit 33 does not perform the adjustment operation of the image forming condition (S7). In this situation, a useless reference toner pattern can be avoided.

Other embodiments of the present invention will now be described by way of example. In the embodiment described above, the image formation control unit 31 determines whether or not the adjustment operation performed by the image forming condition adjusting unit 33 should be prevented before the reference toner pattern is created. However, it is possible to provide another structure wherein it is determined whether or not the adjustment operation performed by the image forming condition adjusting unit 33 should be prevented after the reference toner pattern is created.

According to the structure a useless reference toner pattern can be avoided.

Further, the dot number counter 34 calculates the number of bits based on the output image data, and therefore it is not necessary to actually form the print image. Therefore, it is possible to calculate the number of bits before the reference toner pattern is created.

In the embodiment described above, the image forming condition adjusting unit 33 maintains the print density at a set density through the adjustment of the developing bias voltage. However, the adjustment is not limited to the developing bias voltage. For example, it is possible to provide another structure in which a transfer bias voltage is adjusted. Additionally, another structure can be used in which the gradation conversion table data is rewritten.

A gradation conversion table is a lookup table for numeric conversion of input image data into output image data in which a desired gradation can be secured, and has predetermined gradation characteristic as illustrated, for example, in FIG. 8. The image forming condition adjusting unit 33 corrects the table data so that the toner density increases if the image density of the reference toner pattern detected by the toner density sensor 25 is low while the toner density decreases if the detected density is high.

In the embodiment described above, the image carrier is the photosensitive member 20*c*. However, the image carrier may be the intermediate transfer belt 21.

In this situation, the toner density sensor 25 is located at a position different from that in the embodiment described above. Specifically, the toner density sensor 25, according to the embodiment described above, is located so as to be opposed to the surface of the photosensitive member 20*c*, but the toner density sensor 25 in the case of this structure is located so as to be opposed to the intermediate transfer belt 21 as illustrated in FIG. 9, for instance. The image density of the reference toner pattern after being transferred from the photosensitive member 20*c* to the intermediate transfer belt 21 is thereby detected.

In the embodiment described above, the image forming apparatus, according to the present invention, is the digital multifunction peripheral for single side printing as illustrated in FIG. 3. However, the image forming apparatus according to the present invention may be a digital multifunction peripheral for duplex printing as illustrated in FIG. 10.

In the embodiment described above, the image forming apparatus according to the present invention is the color digital multifunction peripheral, it is not limited thereto and can be a monochrome machine.

In the case of the monochrome machine, the image formation control unit 31 includes the dot number counter 34 for counting the number of dots that constitute the print image, and has a structure in which if the total of the counted values of the predetermined number of print images counted by the dot number counter 34 is greater than a predetermined threshold value, it is determined that the toner amount that is used for the print image is greater than a predetermined value. In other words, in the case of the monochrome machine, the dot number counter 34 counts the number of dots of a single color instead of the number of dots of each of the toner colors.

In the embodiment described above, the image forming apparatus according to the present invention is the digital multifunction peripheral. However, it is not limited thereto, but may be, for example, a copying machine, a printer or the like.

As described above, according to the present invention, it is possible to provide the image forming apparatus capable of stabilizing a image density of a print image by avoiding an incorrect implementation of the adjustment of the image forming condition even if an image having a high image density is printed in the case where the reference toner pattern is formed between images under printing and the adjustment of the image forming condition is performed during the printing period.

Note that each of the embodiments described above is merely an example of the present invention, and the scope of the present invention is not limited by the description. Of course, the structures of individual units can be modified as necessary within the scope of the present invention.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus, comprising:

an image formation control unit for forming print images on an image carrier and for fanning a reference toner pattern between the print images formed on the image carrier;

a reference image density detecting unit for determining an image density of the reference toner pattern; and an image forming condition adjusting unit for adjusting an image forming condition based on the image density detected by the reference image density detecting unit, wherein the image formation control unit:

includes a print image toner amount estimating unit for estimating a toner amount of at least one of the print images and causes the image forming condition adjusting unit to perform an adjustment operation based on the image density of the reference toner pattern detected by the reference image density detecting unit if the toner amount of at least one of the print images is less than a predetermined value; and prevents the image forming condition adjusting unit from further performing the adjustment operation if the toner amount of at least one of the print images is greater than the predetermined value.

2. The image forming apparatus according to claim 1, wherein:

the image formation control unit forms print images, having different toner colors from each other, on the image carrier and forms the reference toner pattern, for each of the different toner colors, between the print images formed on the image carrier; and the image forming condition adjusting unit adjusts the image forming condition of the each of the different toner colors based on the image density detected by the reference image density detecting unit.

3. The image forming apparatus according to claim 2, wherein the print image toner amount estimating unit comprises a dot number counter for counting a number of dots constituting at least one of the print images for the each of the different toner colors, and determines, if at least one of the total counted values of a predetermined number of the print images of the each of the different toner colors counted by the dot number counter is greater than a predetermined threshold value, that the toner amount to be used for the at least one print images is greater than the predetermined value.

4. The image forming apparatus according to claim 2, wherein the print image toner amount estimating unit comprises a dot number counter for counting a number of dots constituting at least one of the print images for the each of the different toner colors, and determines, if the total counted values of a predetermined number of the print images of the each of the different toner colors counted by the dot number counter is greater than a predetermined threshold value, that the toner amount to be used for the at least one of the print images is greater than the predetermined value, so as to prevent the adjustment operation for a toner color concerned performed by the image forming condition adjusting unit.

5. The image forming apparatus according to claim 1, wherein the print image toner amount estimating unit comprises a dot number counter for counting a number of dots constituting at least one of the print images, and determines, if a total of counted values of a predetermined number of the print images counted by the dot number counter is greater than a predetermined threshold value, that the toner amount to be used for at least one of the print images is greater than the predetermined value.

6. The image forming apparatus according to claim 1, wherein the image formation control unit suspends a print image formation if the adjustment operation is prevented a predetermined number of times.

7. The image forming apparatus according to claim 6, wherein the image formation control unit forms the reference toner pattern without forming the print images after the print image formation is suspended to activate the image forming condition adjusting unit.

8. An image forming apparatus, comprising:

an image control unit for forming a reference toner pattern between print images on an image carrier;

a reference image density detecting unit for determining an image density of the reference toner pattern; and an adjusting unit, the image formation control unit includes a print image toner amount estimating unit for estimating a toner amount of at least one of the print images and causes the image adjusting unit to perform an adjustment operation based on the image density of the reference toner pattern if the toner amount of at least one of the print images is less than a predetermined value; and prevents the adjusting unit from further performing the adjustment operation if the toner amount of at least one of the print images is greater than the predetermined value.

9. An image forming apparatus, comprising:

an image formation control unit for forming print images on an image carrier and for foiming a reference toner pattern between the print images formed on the image carrier;

a reference image density detecting unit for determining an image density of the reference toner pattern; and an image forming condition adjusting unit for adjusting an image forming condition based on the image density detected by the reference image density detecting unit, wherein the image formation control unit:

includes a print image toner amount estimating unit for estimating a toner amount of at least one of the print images and causes the image forming condition adjusting unit to perform a forming operation to form the reference toner pattern and an adjustment operation based on the image density of the reference toner pattern detected by the reference image density detecting unit if the toner amount of the reference toner pattern is less than a predetermined value; and prevents the image forming condition adjusting unit from further performing the forming operation and the adjustment operation if the toner amount of the reference toner pattern is greater than the predetermined value.

* * * * *